US008436221B2

(12) United States Patent
Hommeltoft et al.

(10) Patent No.: US 8,436,221 B2
(45) Date of Patent: May 7, 2013

(54) PROCESSES FOR UPGRADING FISCHER-TROPSCH CONDENSATE OLEFINS BY ALKYLATION OF HYDROCRACKATE

(75) Inventors: Sven Ivar Hommeltoft, Pleasant Hill, CA (US); Bi-Zeng Zhan, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 323 days.

(21) Appl. No.: 12/975,752

(22) Filed: Dec. 22, 2010

(65) Prior Publication Data

US 2012/0160739 A1 Jun. 28, 2012

(51) Int. Cl.
*C07C 2/62* (2006.01)
*C07C 2/60* (2006.01)

(52) U.S. Cl.
USPC ..... 585/331; 585/717; 585/722; 585/727; 585/728

(58) Field of Classification Search ..... 585/717, 585/722, 727, 728, 331
See application file for complete search history.

(56) References Cited

U.S. PATENT DOCUMENTS

| | | | |
|---|---|---|---|
| 5,292,983 | A | 3/1994 | Sie |
| 6,743,962 | B2 | 6/2004 | O'Rear et al. |
| 6,768,035 | B2 | 7/2004 | O'Rear et al. |
| 7,569,740 | B2 | 8/2009 | Elomari |
| 2010/0025296 | A1 | 2/2010 | Hommeltoft |

*Primary Examiner* — Thuan D Dang
(74) *Attorney, Agent, or Firm* — Susan M. Abernathy; Steven H. Roth

(57) ABSTRACT

Processes for upgrading Fischer-Tropsch condensate olefins by alkylation of hydrocrackate may involve providing an olefin enriched condensate stream and further providing a Fischer-Tropsch derived hydrocarbon stream comprising wax, hydrocracking the latter Fischer-Tropsch hydrocarbon stream to provide a distillate enriched hydrocracked product comprising isoparaffins, and alkylating the olefins with the isoparaffins in an alkylation zone to provide an alkylate product. The alkylate product may be fed to a distillation unit together with the hydrocracked product, while a naphtha containing fraction from the distillation unit may be fed to the alkylation zone together with the olefin enriched hydrocarbon stream.

18 Claims, 3 Drawing Sheets

PROCESSES FOR UPGRADING FISCHER-TROPSCH CONDENSATE OLEFINS BY ALKYLATION OF HYDROCRACKATE

TECHNICAL FIELD

The present invention relates to processes for upgrading Fischer-Tropsch condensate olefins by alkylation of hydrocrackate.

BACKGROUND

In a conventional process for making transportation fuel, Fischer-Tropsch derived wax is cracked to make diesel fuel. However, the Fischer-Tropsch process also produces condensate, which is predominantly a combination of alkanes, olefins, and alcohols in the $C_3$-$C_{18}$ range. The $C_{9+}$ condensate fraction can be blended into diesel, optionally after hydrotreating; but the $C_8$ and lighter ($C_{8-}$) fraction comprises a naphtha range blend that typically has less value than the distillate range products. Also, the cracking of Fischer-Tropsch wax to make diesel fuel is accompanied by the formation of relatively low value hydrocrackate naphtha.

There is a need for processes for upgrading Fischer-Tropsch derived hydrocarbon fractions, including Fischer-Tropsch light condensate and Fischer-Tropsch derived hydrocrackate naphtha, while maximizing the yield of distillate.

SUMMARY

Figure 1:
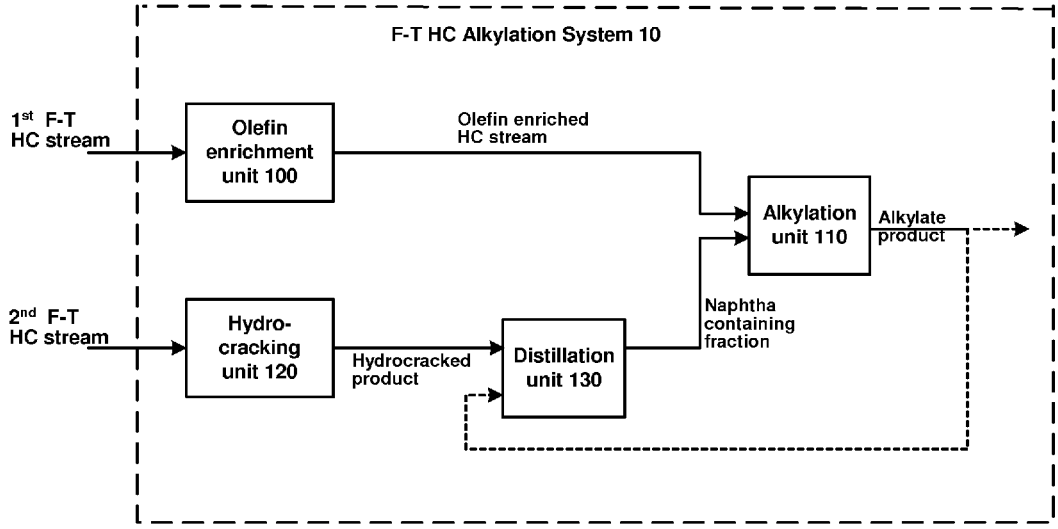
FIG. 1 represents a scheme for a hydrocarbon alkylation process using Fischer-Tropsch derived hydrocarbon feeds, according to an embodiment of the present invention.

An alkylation process according to one aspect of the present invention may involve providing a first Fischer-Tropsch derived hydrocarbon stream comprising olefins, providing a second Fischer-Tropsch derived hydrocarbon stream comprising wax, contacting the second Fischer-Tropsch derived hydrocarbon stream with a hydrocracking catalyst in a hydrocracking zone under hydrocracking conditions to provide a distillate enriched hydrocracked product comprising isoparaffins, and contacting the olefins with the isoparaffins in an alkylation zone under alkylation conditions to provide an alkylate product comprising more than 50 vol % $C_9$-$C_{25}$ distillate.

In another embodiment, the present invention further provides an alkylation process comprising treating a first Fischer-Tropsch derived hydrocarbon stream in an olefin enrichment zone under olefin enrichment conditions to provide an olefin enriched hydrocarbon stream comprising one or more olefins; contacting a second Fischer-Tropsch derived hydrocarbon stream with a hydrocracking catalyst in a hydrocracking zone under hydrocracking conditions to provide a distillate enriched hydrocracked product; feeding the distillate enriched hydrocracked product to a distillation unit; separating a naphtha containing fraction via the distillation unit, wherein the naphtha containing fraction comprises one or more isoparaffins; feeding the naphtha containing fraction to an alkylation zone; concurrently with the prior step, feeding the olefin enriched hydrocarbon stream to the alkylation zone; contacting the one or more isoparaffins with the one or more olefins in the presence of an ionic liquid catalyst under alkylation conditions in the alkylation zone to provide an alkylate product; and feeding the alkylate product, together with the distillate enriched hydrocracked product, to the distillation unit.

In a further embodiment, the present invention also provides an alkylation process comprising treating a first Fischer-Tropsch derived hydrocarbon stream comprising condensate in an olefin enrichment zone under olefin enrichment conditions to provide an olefin enriched hydrocarbon stream comprising one or more olefins; contacting a second Fischer-Tropsch derived hydrocarbon stream comprising wax with a hydrocracking catalyst in a hydrocracking zone under hydrocracking conditions to provide a distillate enriched hydrocracked product; feeding the distillate enriched hydrocracked product to a distillation unit; separating a naphtha containing fraction via the distillation unit, wherein the naphtha containing fraction comprises at least one $C_4$-$C_8$ isoparaffin; concurrently feeding the naphtha containing fraction, the olefin enriched hydrocarbon stream, and a third Fischer-Tropsch derived hydrocarbon stream to the alkylation zone; contacting the naphtha containing fraction with the olefin enriched hydrocarbon stream and the third Fischer-Tropsch derived hydrocarbon stream in the presence of an ionic liquid catalyst under alkylation conditions in the alkylation zone to provide an alkylate product; feeding the alkylate product, together with the distillate enriched hydrocracked product, to the distillation unit, wherein the alkylate product comprises more than 50 vol % $C_9$-$C_{25}$ distillate; and providing a distillate product via the distillation unit.

As used herein, the terms "comprising" and "comprises" mean the inclusion of named elements or steps that are identified following those terms, but not necessarily excluding other unnamed elements or steps.

The term "Periodic Table" as referred to herein is the IUPAC version of the Periodic Table of the Elements dated Jun. 22, 2007, and the numbering scheme for the Periodic Table Groups is as described in Chemical and Engineering News, 63(5), 27 (1985).

DETAILED DESCRIPTION

In an embodiment, the present invention may find applications in upgrading Fischer-Tropsch condensate olefins, together with olefins formed by dehydration of oxygenate components of Fischer-Tropsch condensate, by olefin alkylation with alkylatable hydrocarbon components of Fischer-Tropsch wax hydrocrackate. In an embodiment, a Fischer-Tropsch condensate alkylation system of the present invention may include a Fischer-Tropsch synthesis unit, a dehydration zone, an alkylation zone, a hydrocracker, and a distillation unit. Feeds to the distillation unit may include a distillate enriched hydrocracked product from the hydrocracker and an alkylate product from the alkylation zone. Feeds to the alkylation zone may include an olefin enriched (oxygenate depleted) Fischer-Tropsch condensate from the dehydration zone, LPG from the Fischer-Tropsch synthesis unit, and an isobutane containing naphtha fraction from the distillation unit.

Ionic Liquid Catalysts

In an embodiment, alkylation processes according to the present invention may use a catalytic composition comprising at least one metal halide and at least one quaternary ammonium halide and/or at least one amine halohydride. The ionic liquid catalyst can be any halogen aluminate ionic liquid catalyst, e.g., comprising an alkyl substituted quaternary amine halide, an alkyl substituted pyridinium halide, or an alkyl substituted imidazolium halide of the general formula $N^+R_4X^-$. As an example, ionic liquid catalysts useful in practicing the present invention may be represented by the general formulas A and B,

A

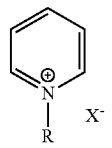

B

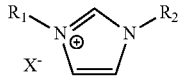

wherein R=H, methyl, ethyl, propyl, butyl, pentyl or hexyl, and X is a halide, and $R_1$ and $R_2$=H, methyl, ethyl, propyl, butyl, pentyl or hexyl, wherein $R_1$ and $R_2$ may or may not be the same. In an embodiment, X is chloride.

An exemplary metal halide that may be used in accordance with the present invention is aluminum chloride ($AlCl_3$). Quaternary ammonium halides which can be used in accordance with the present invention include those described in U.S. Pat. No. 5,750,455, the disclosure of which is incorporated by reference herein.

In an embodiment, the ionic liquid catalyst may be a chloroaluminate ionic liquid prepared by mixing $AlCl_3$ and an alkyl substituted pyridinium halide, an alkyl substituted imidazolium halide, a trialkylammonium hydrohalide, or a tetraalkylammonium halide, as disclosed in commonly assigned U.S. Pat. No. 7,495,144, the disclosure of which is incorporated by reference herein in its entirety.

In a sub-embodiment, the ionic liquid catalyst may comprise N-butylpyridinium heptachlorodialuminate ionic liquid, which may be prepared, for example, by combining $AlCl_3$ with a salt of the general formula A, supra, wherein R is n-butyl and X is chloride. The present invention is not limited to any particular ionic liquid catalyst composition(s).

Fischer-Tropsch Derived Hydrocarbon Alkylation Systems and Processes

FIG. 1 represents a scheme for an alkylation process using a plurality of Fischer-Tropsch derived hydrocarbon streams, according to an embodiment of the present invention. Fischer-Tropsch derived hydrocarbon alkylation system 10 may include an olefin enrichment unit 100, a hydrocracking unit 120, a distillation unit 130, and an alkylation unit 110.

A first Fischer-Tropsch derived hydrocarbon stream may be fed to olefin enrichment unit 100. The first Fischer-Tropsch hydrocarbon stream may comprise a condensate comprising olefins and oxygenates. In an embodiment, the first Fischer-Tropsch hydrocarbon stream may typically comprise from about 10 to 60 wt % olefins, and from about 1 to 15 wt % oxygenates. In contrast, the olefin enriched hydrocarbon stream emanating from olefin enrichment unit 100 may typically comprise less than about 0.5 wt % oxygenates.

The oxygenates present in the first Fischer-Tropsch hydrocarbon stream may comprise predominantly alcohols, typically primary alcohols, usually alkanols, and often alkanols in the $C_3$ to $C_{15}$ range. The oxygenates may further comprise relatively minor amounts of carboxylic acids, aldehydes, ketones, and the like. The oxygenates in the first Fischer-Tropsch hydrocarbon stream may be removed or converted to olefins to provide an olefin enriched hydrocarbon stream (see, e.g., FIG. 2). As an example, the alcohols may be dehydrated to olefins, e.g., by treatment with a dehydrating catalyst, thereby increasing the quantity of alkylatable olefins in the feed to alkylation unit 110.

Figure 2:
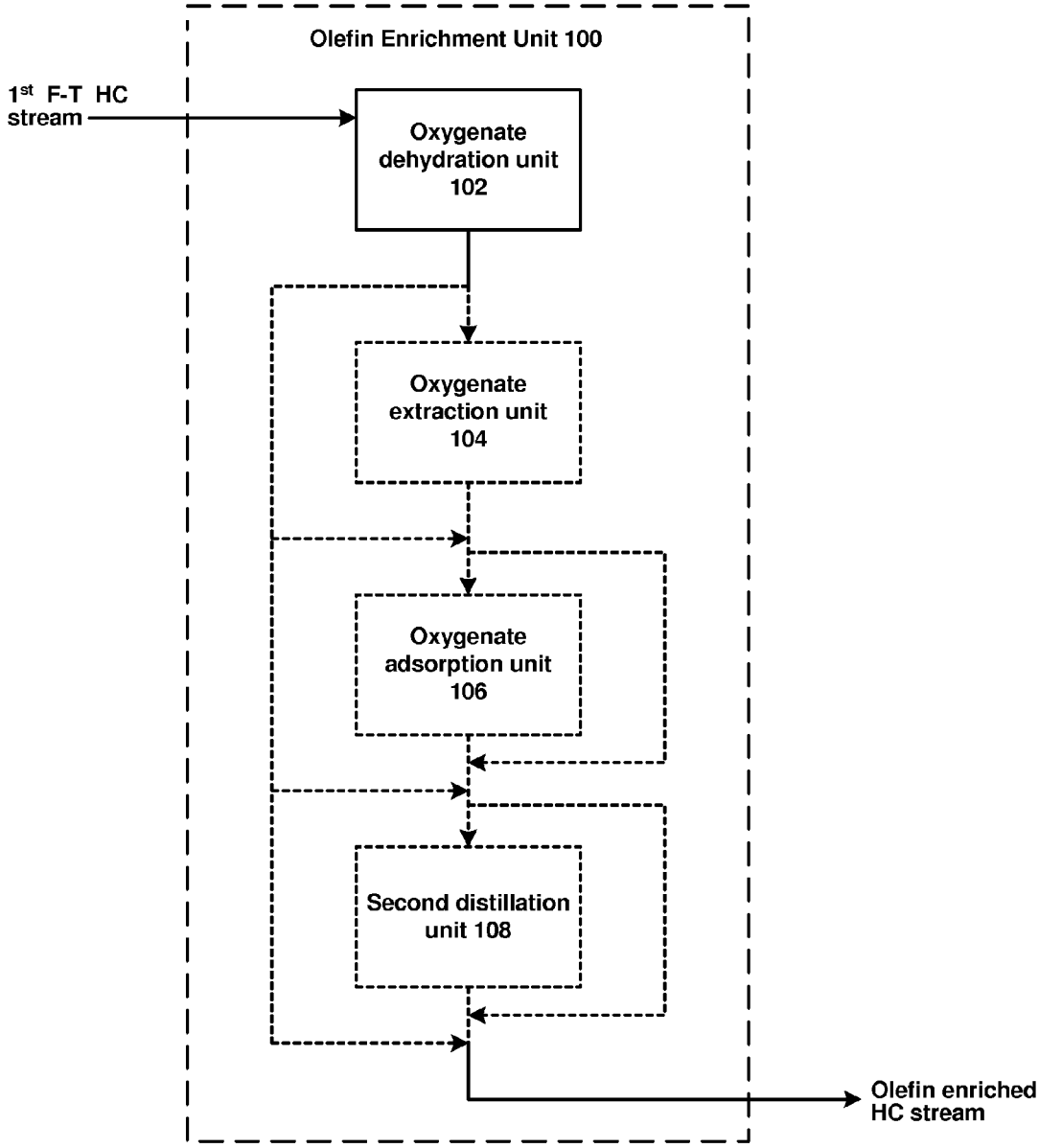
FIG. 2 represents a scheme for an olefin enrichment process using an oxygenated Fischer-Tropsch hydrocarbon feed, according to an aspect of the process of FIG. 1.

In another embodiment, treatment of the first Fischer-Tropsch hydrocarbon stream in olefin enrichment unit 100 may further include the removal of residual oxygenates and/or water from the olefin enriched hydrocarbon stream using an oxygenate extraction unit 104, an adsorption unit 106, and/or a second distillation unit 108 (see, for example, FIG. 2). Various methods and techniques for removing oxygenates from hydrocarbon streams are disclosed in U.S. Pat. No. 6,743,962 to O'Rear et al., the disclosure of which is incorporated by reference herein in its entirety.

A second Fischer-Tropsch derived hydrocarbon stream may be fed to hydrocracking unit 120. The second Fischer-Tropsch derived hydrocarbon stream may be heavier than the first Fischer-Tropsch derived hydrocarbon stream. As a non-limiting example, the first Fischer-Tropsch hydrocarbon stream may comprise a $C_{8-}$ Fischer-Tropsch condensate, while the second Fischer-Tropsch hydrocarbon stream may comprise a $C_{9+}$ Fischer-Tropsch condensate and Fischer-Tropsch wax. As another non-limiting example, the first Fischer-Tropsch hydrocarbon stream may comprise a $C_{18-}$ Fischer-Tropsch condensate, while the second Fischer-Tropsch hydrocarbon stream may comprise Fischer-Tropsch wax (e.g., comprising $C_{19+}$ alkanes). In an embodiment, the second Fischer-Tropsch hydrocarbon stream may consist essentially of Fischer-Tropsch wax.

The second Fischer-Tropsch hydrocarbon stream may be contacted with a hydrocracking catalyst in hydrocracking unit 120 under hydrocracking conditions to provide a hydrocracked product comprising isoparaffins. Hydrocracking unit 120 may also be referred to herein as a hydrocracking zone. In an embodiment, the hydrocracked product may be enriched with distillate and may be referred to herein as a distillate enriched hydrocracked product.

With further reference to FIG. 1, the hydrocracked product may be fed to distillation unit 130. One or more naphtha containing fractions may be separated via distillation unit 130. The naphtha containing fractions may comprise isoparaffins, e.g., $C_4$-$C_8$ isoparaffins. The naphtha containing fraction(s) may be fed to alkylation unit 110 together with the olefin enriched hydrocarbon stream from olefin enrichment unit 100. Alkylation unit 110 may also be referred to herein as an alkylation zone. The olefins may be contacted with the isoparaffins in alkylation unit 110 under alkylation conditions to provide an alkylate product. The alkylate product may typically be within the range of about $C_7$-$C_{60}$, and usually about $C_7$-$C_{25}$. In an embodiment, the alkylate product may comprise more than 50 vol % $C_9$-$C_{25}$ distillate, and in a sub-embodiment more than 70 vol % $C_9$-$C_{25}$ distillate. In another embodiment, the alkylate product may comprise more than 50 vol % $C_{10}$-$C_{20}$ distillate, and in a sub-embodiment more than 70 vol % $C_{10}$-$C_{20}$ distillate. In an embodiment, the alkylate product may be fed to distillation unit 130 together with the hydrocracked product.

The olefin-isoparaffin alkylation reaction in alkylation unit 110 may be catalyzed by an ionic liquid catalyst. The ionic liquid catalyst may have a composition as described hereinabove, e.g., as represented by the general formulas A and B, supra. In an embodiment, the ionic liquid catalyst may comprise a chloroaluminate ionic liquid. The ionic liquid catalyst may be used in conjunction with a catalyst promoter, such as anhydrous HCl or an alkyl halide. In an embodiment, the catalyst promoter may comprise a $C_2$-$C_6$ alkyl chloride, such as n-butyl chloride or t-butyl chloride.

The reactant(s) and ionic liquid catalyst within alkylation unit 110 may be vigorously mixed to promote contact therebetween. During the alkylation process, alkylation unit 110 may contain a mixture comprising ionic liquid catalyst and a hydrocarbon phase, wherein the hydrocarbon phase may comprise at least one alkylate product. In an embodiment, the ionic liquid catalyst may be separated from the hydrocarbon phase via a catalyst/hydrocarbon separator (not shown), wherein the hydrocarbon and ionic liquid catalyst phases may be allowed to settle under gravity, by using a coalescer, or by a combination thereof. The use of coalescers for liquid-liquid separations is described in commonly assigned US Publication Number 20100130800A1, the disclosure of which is incorporated by reference herein in its entirety.

Figure 3A:
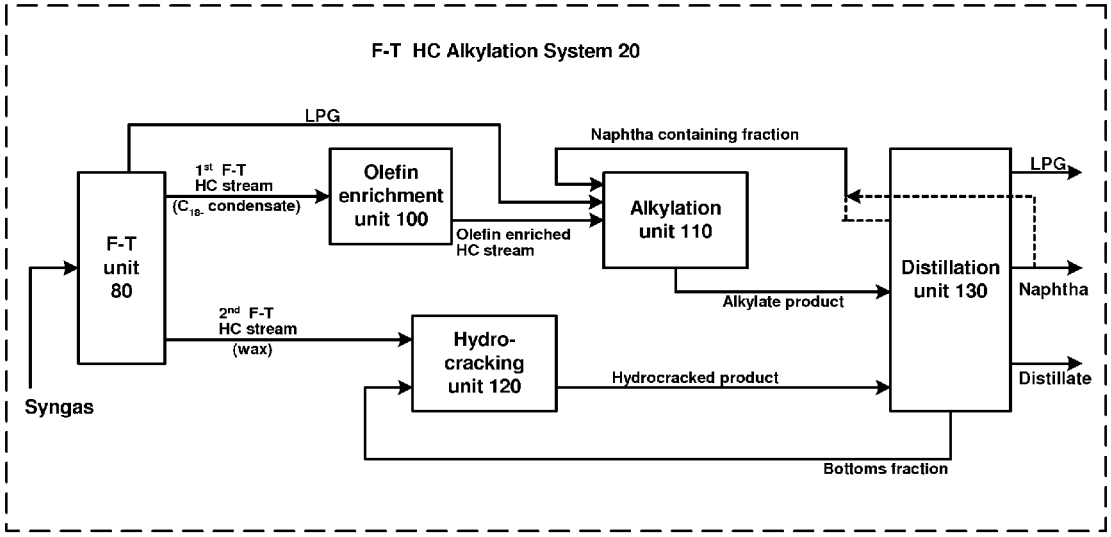
FIGS. 3A and 3B each represent a scheme for a hydrocarbon alkylation process using an olefin enriched Fischer-Tropsch condensate and Fischer-Tropsch derived hydrocrackate, according to the present invention.

FIG. 3A represents a scheme for an ionic liquid catalyzed alkylation process using a plurality of Fischer-Tropsch derived hydrocarbon streams, according to another embodiment of the present invention. As shown in FIG. 3A, a Fischer-Tropsch hydrocarbon alkylation system 20 may include a Fischer-Tropsch synthesis unit 80, an olefin enrichment unit 100, an alkylation unit 110, a hydrocracking unit 120, and a distillation unit 130. Synthesis gas (syngas) may be fed to Fischer-Tropsch unit 80 for Fischer-Tropsch hydrocarbon synthesis, as is well known in the art. The product(s) from Fischer-Tropsch synthesis unit 80 may be separated into LPG (liquefied petroleum gas), as well as first and second Fischer-Tropsch derived hydrocarbon streams. In the embodiment of FIG. 3A, the first Fischer-Tropsch hydrocarbon stream may comprise $C_{18-}$ Fischer-Tropsch condensate, while the second Fischer-Tropsch hydrocarbon stream may comprise Fischer-Tropsch wax.

The first Fischer-Tropsch derived hydrocarbon stream may comprise substantial quantities of oxygenates in addition to olefins. Ionic liquid catalysts may be susceptible to deactivation by oxygenates in the feed. In an embodiment, the oxygenates may be removed from the feed by treatment of the first Fischer-Tropsch hydrocarbon stream in olefin enrichment unit 100 to provide an olefin enriched hydrocarbon stream. Such treatment of the first Fischer-Tropsch hydrocarbon stream may be performed substantially as described herein with reference to FIG. 2, infra.

The olefin enriched hydrocarbon stream may be fed to alkylation unit 110. In an embodiment, the alkylation reaction may be performed by contacting the olefins with isoparaffins in alkylation unit 110 in the presence of an ionic liquid catalyst to provide alkylate product. In an embodiment, the olefin enriched hydrocarbon stream may be fed to alkylation unit 110 together (e.g., concurrently) with LPG from Fischer-Tropsch unit 80. LPG from Fischer-Tropsch unit 80 may represent a third Fischer-Tropsch derived hydrocarbon stream comprising at least one $C_3$-$C_4$ olefin, which may be alkylated with isoparaffins in alkylation unit 110 to provide additional alkylate product. The alkylate product from alkylation unit 110 may comprise predominantly distillate material, e.g., substantially as described hereinabove with reference to FIG. 1.

In an embodiment, the ionic liquid catalyst in alkylation unit 110 may comprise a chloroaluminate ionic liquid. Reaction conditions for ionic liquid catalyzed olefin-isoparaffin alkylation are described hereinbelow. According to one aspect of the present invention the alkylation conditions within alkylation unit 110 may be selected to inhibit olefin oligomerization. While not being bound by theory, and as a non-limiting example only, alkylation may be favored at the expense of olefin oligomerization by increasing the relative amount of co-catalyst (e.g., HCl or alkyl halide) in alkylation unit 110.

The second Fischer-Tropsch derived hydrocarbon stream (e.g., comprising $C_{19+}$ wax) may be fed to hydrocracking unit 120 to provide a hydrocracked product. In an embodiment, the hydrocracked product may be rich in distillate range material, and may be referred to herein as a distillate enriched hydrocracked product. The distillate enriched hydrocracked product may be fed to distillation unit 130. The alkylate product may also be fed from alkylation unit 110 to distillation unit 130 together (e.g., concurrently) with the distillate enriched hydrocracked product.

According to an aspect of the instant invention, at least one naphtha containing fraction may be separated via distillation unit 130, and the naphtha containing fraction may also be fed to alkylation unit 110. In an embodiment, the naphtha containing fraction may comprise a light naphtha fraction comprising $C_4$-$C_8$ isoparaffins. In another embodiment, the naphtha containing fraction fed to alkylation unit 110 may comprise $C_5$-$C_8$ isoparaffins. In another embodiment, the naphtha containing fraction fed to alkylation unit 110 may comprise a partial draw from each of a $C_5$-$C_8$ naphtha cut and a $C_4$-$C_8$ light naphtha cut from distillation unit 130.

According to an aspect of the instant invention, distillate may be obtained from distillation unit 130 as a major product, together with a relatively minor amount of naphtha product. In an embodiment, an LPG product and a bottoms fraction may also be separated via distillation unit 130. In a sub-embodiment, the bottoms fraction may be recycled to hydrocracking unit 120 to provide additional hydrocracked product.

Figure 3B:
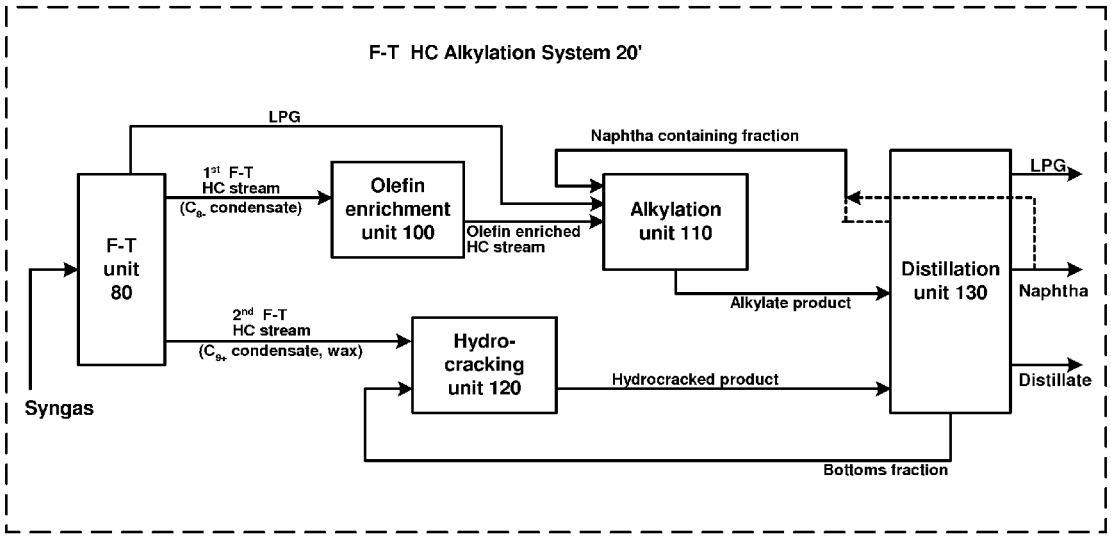

FIG. 3B represents a scheme for an ionic liquid catalyzed alkylation process using a plurality of Fischer-Tropsch derived hydrocarbon streams, according to another embodiment of the present invention. As shown in FIG. 3B, a Fischer-Tropsch hydrocarbon alkylation system 20' may include a Fischer-Tropsch synthesis unit 80, an olefin enrichment unit 100, an alkylation unit 110, a hydrocracking unit 120, and a distillation unit 130, substantially as described with reference to FIG. 3A. In an embodiment, a first Fischer-Tropsch derived hydrocarbon stream may be fed to olefin enrichment unit 100 maintained under olefin enrichment conditions to provide an olefin enriched hydrocarbon stream comprising one or more olefins, e.g., substantially as described with reference to FIG. 2. Thereafter, the olefin enriched stream may be fed to alkylation unit 110 to participate in ionic liquid catalyzed olefin-isoparaffin alkylation reactions.

In the embodiment of FIG. 3B, the first Fischer-Tropsch derived hydrocarbon stream may comprise a $C_{8-}$ Fischer-Tropsch condensate, while the second Fischer-Tropsch derived hydrocarbon stream may comprise a $C_{9+}$ Fischer-Tropsch condensate and Fischer-Tropsch derived wax. The process of FIG. 3B may be performed substantially as described hereinabove with reference to FIG. 3A to provide distillate as a major product.

Reaction Conditions for Ionic Liquid Catalyzed Alkylation

Due to the low solubility of hydrocarbons in ionic liquids, hydrocarbon conversion reactions in ionic liquids (including isoparaffin-olefin alkylation reactions) are generally biphasic and occur at the interface in the liquid state. The volume of ionic liquid catalyst in the reactor may be generally in the range from about 1 to 70 vol %, and usually from about 4 to 50 vol %. Generally, vigorous mixing (e.g., stirring or Venturi nozzle dispensing) is used to ensure good contact between the reactants and the ionic liquid catalyst.

The reaction temperature may be generally in the range from about 0° F. to 400° F., typically from about 30° F. to 210° F., and often from about 80° F. to 140° F. The reactor pressure may be in the range from atmospheric pressure to about 3000 psi. Typically, the reactor pressure is sufficient to keep the reactants in the liquid phase. Residence time of reactants in the reactor may generally be in the range from a few seconds to hours, and usually from about 0.5 min to 60 min. The feeds to alkylation unit 110 may provide an isoparaffin:olefin molar ratio generally in the range from about 1 to 100, more typically from about 2 to 50, and often from about 2 to 20. The ionic liquid catalyzed alkylation of isoparaffins with olefins is disclosed, for example, in commonly assigned U.S. Pat. No. 7,432,408 to Timken et al., the disclosure of which is incorporated by reference herein in its entirety.

With continued operation of alkylation unit 110, the ionic liquid catalyst may become partially deactivated or spent. In order to maintain the catalytic activity, at least a portion of the ionic liquid phase may be fed to a catalyst regeneration unit (not shown) for regeneration of the ionic liquid catalyst. Processes for the regeneration of ionic liquid catalyst during ionic liquid catalyzed hydrocarbon conversion processes are disclosed in the patent literature (see, for example, U.S. Pat. Nos. 7,732,364 and 7,674,739, the disclosures of which are incorporated by reference herein in their entirety).

Olefin Enrichment of Oxygenated Hydrocarbon Streams

FIG. 2 represents a scheme for olefin enrichment of an oxygenate containing hydrocarbon feed, according to an aspect of processes of the present invention. The oxygenated hydrocarbon stream may be, for example, a $C_{8-}$ Fischer-Tropsch condensate or a $C_{18-}$ Fischer-Tropsch condensate. In an embodiment, the oxygenate containing hydrocarbon stream may comprise from about 10 to 60 wt % olefins and from about 1 to 15 wt % oxygenates.

With further reference to FIG. 2, olefin enrichment unit 100 may comprise an oxygenate dehydration unit 102. Oxygenate dehydration unit 102 may include a dehydration catalyst. Oxygenate dehydration unit 102 may also be referred to herein as a dehydration zone. In an embodiment, a process for treating an oxygenate containing hydrocarbon stream may comprise dehydrating the oxygenates by contacting the oxygenate containing hydrocarbon stream with the dehydration catalyst in the dehydration zone under dehydration conditions. In an embodiment, the oxygenates present in the oxygenated hydrocarbon stream may comprise predominantly alcohols, and the alcohols may be converted to olefins by contacting the oxygenated hydrocarbon stream with the dehydration catalyst to provide an olefin enriched hydrocarbon stream.

In an embodiment, the dehydration catalyst may be selected from the group consisting of alumina and amorphous silica-alumina. In a sub-embodiment, the dehydration catalyst may comprise alumina doped with an element selected from the group consisting of phosphorus, boron, fluorine, zirconium, titanium, gallium, and combinations thereof. In another sub-embodiment, the dehydration catalyst may comprise amorphous silica-alumina doped with an element selected from the group consisting of phosphorus, boron, fluorine, zirconium, titanium, gallium, and combinations thereof.

The dehydration conditions for dehydrating oxygenates, e.g., alkanols, in the oxygenated hydrocarbon stream may include a temperature in the range from about 300° F. to 780° F., a pressure in the range from atmospheric to about 2000 psig, and a liquid hourly space velocity (LHSV) feed rate in the range from about 0.1 to 50 $hr^{-1}$.

With still further reference to FIG. 2, olefin enrichment unit 100 for treating an oxygenated hydrocarbon stream may optionally further include one or more of an oxygenate extraction unit 104, an oxygenate adsorption unit 106, and a second distillation unit 108. In an embodiment, the treatment of an oxygenated hydrocarbon stream according to the present invention may optionally include the use of oxygenate extraction unit 104 for extracting or washing the hydrocarbon stream with an aqueous medium, whereby residual oxygenates may be removed from the hydrocarbon stream.

In an embodiment, an olefin enrichment process of the present invention may optionally further include contacting the hydrocarbon stream with an adsorbent in oxygenate adsorption unit 106, whereby residual oxygenates and/or water may be removed from the hydrocarbon stream. In a sub-embodiment, the adsorbent may comprise a molecular sieve, such as zeolite 13X. Zeolites and molecular sieves are well known in the art (see, for example, *Zeolites in Industrial Separation and Catalysis*, By Santi Kulprathipanja, Pub. Wiley-VCH, 2010). In an embodiment, the hydrocarbon stream may be fed to adsorption unit 106 from oxygenate extraction unit 104. Alternatively, oxygenate extraction unit 104 may be omitted or bypassed, and the hydrocarbon stream may be fed to adsorption unit 106 directly from dehydration unit 102.

In yet another embodiment of the present invention, olefin enrichment unit 100 may optionally further include a second distillation unit 108. As a non-limiting example, second distillation unit 108 may be used to remove a heavy fraction from the hydrocarbon stream prior to ionic liquid catalyzed alkylation processes of the present invention.

Hydrodechlorination of Ionic Liquid Catalyzed Alkylation Products

In an embodiment of the present invention, the products from ionic liquid catalyzed alkylation may typically comprise one or more halogenated components, and may have an organic chloride content generally in the range from about 50 ppm to 5000 ppm, typically from about 100 ppm to 4000 ppm, and often from about 200 ppm to 2000 ppm. Chlorinated hydrocarbon products of processes of the present invention, e.g., distillate fuel, may be hydrodechlorinated by contact with a hydrodechlorination catalyst in the presence of hydrogen under hydrodechlorination conditions to provide one or more dechlorinated hydrocarbon products. The hydrodechlorination of products from ionic liquid catalyzed hydrocarbon conversion processes are disclosed in commonly assigned U.S. patent application Ser. No. 12/847,313 entitled Hydrodechlorination of ionic liquid-derived hydrocarbon products, the disclosure of which is incorporated by reference herein in its entirety.

Certain features of the various embodiments may be combined with features of other embodiments to provide further embodiments of the present invention in addition to those embodiments specifically described or shown as such.

Numerous variations on the present invention may be possible in light of the teachings described herein. It is therefore understood that within the scope of the following claims, the invention may be practiced otherwise than as specifically described or exemplified herein.

What is claimed is:

1. An alkylation process, comprising:

a) providing a first Fischer-Tropsch derived hydrocarbon stream comprising olefins;

b) providing a second Fischer-Tropsch derived hydrocarbon stream comprising wax;

c) contacting the second Fischer-Tropsch derived hydrocarbon stream with a hydrocracking catalyst in a hydrocracking zone under hydrocracking conditions to provide a distillate enriched hydrocracked product comprising isoparaffins;

d) separating a naphtha containing fraction comprising the isoparaffins from the distillate enriched hydrocracked product; and d) contacting the olefins with the naphtha containing fraction comprising the isoparaffins in an alkylation zone under alkylation conditions in the presence of an ionic liquid catalyst to alkylate to provide an alkylate product comprising more than 50 vol % $C_9$-$C_{25}$ distillate.

2. The process according to claim 1, wherein the first Fischer-Tropsch derived hydrocarbon stream comprises a Fischer-Tropsch condensate comprising oxygenates, and the process further comprises:

f) contacting the first Fischer-Tropsch derived hydrocarbon stream with a dehydration catalyst in a dehydration zone under oxygenate dehydrating conditions to provide an olefin enriched hydrocarbon stream; and wherein step e) comprises:

g) feeding the olefin enriched hydrocarbon stream to the alkylation zone.

3. The process according to claim 1, wherein the first Fischer-Tropsch derived hydrocarbon stream comprises a $C_{18-}$ Fischer-Tropsch condensate.

4. The process according to claim 1, wherein the first Fischer-Tropsch derived hydrocarbon stream comprises a $C_{8-}$ Fischer-Tropsch condensate.

5. The process according to claim 1, wherein the second Fischer-Tropsch derived hydrocarbon stream further comprises a $C_{9+}$ Fischer-Tropsch condensate.

6. The process according to claim 1, wherein the second Fischer-Tropsch derived hydrocarbon stream consists essentially of Fischer-Tropsch derived wax.

7. The process according to claim 1, wherein the ionic liquid catalyst comprises a chloroaluminate ionic liquid.

8. The process according to claim 1, wherein the ionic liquid catalyst comprises N-butylpyridinium heptachlorodialuminate ionic liquid.

9. The process according to claim 1, wherein the alkylation conditions are selected to inhibit olefin oligomerization.

10. The process according to claim 2, further comprising:

h) feeding the distillate enriched hydrocracked product to a distillation unit;

i) separating the naphtha containing fraction from the distillation unit; and j) concurrently with step g), feeding the naphtha containing fraction to the alkylation zone.

11. The process according to claim 10, wherein the naphtha containing fraction comprises $C_4$-$C_8$ isoparaffins.

12. The process according to claim 10, wherein the naphtha containing fraction comprises $C_5$-$C_8$ isoparaffins.

13. The process according to claim 10, further comprising:

k) providing a third Fischer-Tropsch derived hydrocarbon stream comprising at least one $C_3$-$C_4$ olefin; and l) concurrently with step j), feeding the third Fischer-Tropsch derived hydrocarbon stream to the alkylation zone.

14. The process according to claim 13, wherein the third Fischer-Tropsch derived hydrocarbon stream comprises liquefied petroleum gas (LPG).

15. The process according to claim 10, further comprising:

m) concurrently with step h), feeding the alkylate product to the distillation unit.

16. The process according to claim 15, further comprising:

n) providing a distillate product via the distillation unit.

17. The process according to claim 10, further comprising:

o) recycling a bottoms fraction from the distillation unit to the hydrocracking zone.

18. An ionic liquid catalyzed alkylation process for distillate production from a plurality of Fischer-Tropsch derived hydrocarbon streams, the process comprising:

a) treating a first Fischer-Tropsch derived hydrocarbon stream comprising condensate in an olefin enrichment zone under olefin enrichment conditions to provide an olefin enriched hydrocarbon stream comprising one or more olefins;

b) contacting a second Fischer-Tropsch derived hydrocarbon stream comprising wax with a hydrocracking catalyst in a hydrocracking zone under hydrocracking conditions to provide a distillate enriched hydrocracked product;

c) feeding the distillate enriched hydrocracked product to a distillation unit;

d) separating a naphtha containing fraction via the distillation unit, wherein the naphtha containing fraction comprises at least one $C_4$-$C_8$ isoparaffin;

e) feeding the naphtha containing fraction to an alkylation zone;

f) concurrently with step e), feeding the olefin enriched hydrocarbon stream to the alkylation zone;

g) concurrently with step f), feeding a third Fischer-Tropsch derived hydrocarbon stream comprising at least one $C_3$-$C_4$ olefin to the alkylation zone;

h) contacting the naphtha containing fraction with the olefin enriched hydrocarbon stream and the third Fischer-Tropsch derived hydrocarbon stream in the presence of an ionic liquid catalyst under alkylation conditions in the alkylation zone to provide an alkylate product;

i) concurrently with step c), feeding the alkylate product to the distillation unit, wherein the alkylate product comprises more than 50 vol % $C_9$-$C_{25}$ distillate; and j) providing a distillate product via the distillation unit.

* * * * *